United States Patent [19]

Ragusa

[11] Patent Number: 4,612,444

[45] Date of Patent: Sep. 16, 1986

[54] APPARATUS FOR CURING BONDING MATERIAL OF ARTIFICIAL NAIL TIPS

[76] Inventor: Vincent J. Ragusa, 123 Avenue B. S.W., Winter Haven, Fla. 33880

[21] Appl. No.: 760,938

[22] Filed: Jul. 31, 1985

[51] Int. Cl.[4] ..... G21K 5/08

[52] U.S. Cl. ..... 250/492.1; 118/641; 250/494.1; 422/186; 425/174.4; 156/379.6

[58] Field of Search ..... 118/620, 641; 425/2, 425/174 A; 422/186; 250/493.1, 492.1, 494.1, 504; 156/379.6

[56] References Cited

U.S. PATENT DOCUMENTS

| | | | |
|---|---|---|---|
| 3,759,811 | 9/1973 | Platz et al. | 422/186 |
| 4,055,769 | 10/1977 | Sander | 250/492 R |
| 4,508,750 | 4/1985 | Föll et al. | 250/492.1 |
| 4,546,261 | 10/1985 | Gonser et al. | 250/492.1 |
| 4,563,589 | 1/1966 | Scheffer | 250/504 R |

*Primary Examiner*—Willard E. Hoag
*Attorney, Agent, or Firm*—Firjouf, Rust & Pyle

[57] ABSTRACT

A cosmetic apparatus is disclosed for curing an ultravoilet sensitive coating and bonding material applied to the surface of a person's fingernail optionally including an artificial nail tip attached thereon. The apparatus comprises an enclosure having a front face which defines an opening for the reception therein of the artifical nail tip when applied to the fingernail. A plurality of lamps are disposed within the enclosure for emitting ultraviolet light within the enclosure for curing the ultravoilet sensitive coating and bonding material when the person positions the fingernail and applied nail tip within the enclosure. An electrical timer switch controls the energizing of the plurality of lamps and the time period to which the coating and bonding material within the enclosure is exposed to the ultravoilet light. A finger guide slidably extends through the opening for guiding the person's fingernail and applied nail tip to a predetermined location within the enclosure such that the bonding material is evenly cured at the predetermined location.

9 Claims, 14 Drawing Figures

APPARATUS FOR CURING BONDING MATERIAL OF ARTIFICIAL NAIL TIPS

BACKGROUND OF THE INVENTION

1. Field of the Invention

This invention relates to an apparatus for curing an ultraviolet sensitive coating and bonding material which is applied to the surface of a person's fingernail and an artificial nail tip previously applied to the person's fingernail or a person's fingernail without an artificial tip. More particularly, this invention relates to a ultraviolet light curing apparatus having a finger guide for guiding the person's fingernail and applied nail tip to a predetermined location for curing.

2. Information Disclosure Statement

For many years women have spent large sums and expended many hours in beauty salons having their fingernails treated by cosmetologists in order to improve the appearance of their fingernails.

In times past, women's fingernails were worn long and were carefully manicured in order to present a slender, long and uniformly curved configuration. However, in view of the fact that such persons wearing these elegant fingernails were often employed as secretaries working with key operated machines, such as typewriters, much frustration was caused by such slender fingernails breaking through contact with the keys of these typewriters or the like.

In view of this aforementioned problem, various artificial materials were developed so that the artificial nail could be applied over the top of the natural fingernail and thereafter be buffed and filed to the desired configuration.

Not only has the advent of artificial fingernails to a large extent overcome the problem of broken nails, but more particularly a person could instantly have such artificial fingernails applied by a cosmetologist without the need for growing the natural fingernails to the required dimensions.

Usually when such artificial nail tips are applied to the person's fingernail it is necessary that the cosmetologist first of all prepare the person's natural fingernail by cleaning it and by making a straight cut through the tip of the natural fingernail transverse to the length of the fingernail. A nail tip is then selected to match the size of the natural fingernail to which the nail tip is to be applied. Next a small amount of glue, such as a cyanoacrylate glue, is applied to the area of the natural fingernail which is to be overlapped by the nail tip. The nail tip is then placed onto the natural nail and held in place for a few seconds until the glue bonds. A space is left between the artificial nail tip and the cuticle to aid in blending the artificial nail surface to the natural nail surface. The artificial nail tip is then filed to blend in with the person's fingernail. The person's fingernail and artificial nail tip are then coated with a fingernail polish.

In recent practice however, the artificial nail tip is not filed to blend in with the person's natural fingernail. Instead the artificial tip is first bonded to the natural fingernail by the method described above, then an ultravoilet sensitive (curable) bonding material is then applied to both the artificial tip and natural fingernail. The now coated nails are bathed in ultravoilet light initiating polymerization (photoinitiation). That is, the entire nail surface is coated from the cuticle forward as shown in FIG. 12. Prior art apparatus includes lamps and lamp enclosures which provide a source of ultraviolet light for accomplishing the curing process. These apparatus require the holding of the hands at different positions without benefit of total support in order to cure the bonding material. In these prior art apparatus problems have been experienced in that the ultraviolet sensitive material cures unevenly resulting in a tacky and uneven nail surface. Also, burns to the skin have resulted because of the higher watt bulbs used in order to speed the process.

Therefore, it is the primary object of the present invention to provide an apparatus for curing an ultraviolet sensitive coating and bonding material applied to the surface of a person's natural fingernail and an artificial fingernail attached thereon that overcomes the aforementioned inadequacy of the prior art devices and provides an improvement which significantly contributes to the safety and reliability with such bonding material may be cured.

Another object of the present invention is the provision of an apparatus for curing an ultraviolet sensitive coating and bonding material applied to the surface of a person's fingernail and an artificial tip attached thereon, the apparatus including a finger guide slidably extending through an enclosure for guiding the person's fingernail and applied nail tip to a predetermined location within the enclosure such that the coating and bonding material is cured at the predetermined location.

Another object of the present invention is the provision of a curing apparatus which includes an enclosure having a front face which defines an opening for the reception therein of a person's artificial nail tip when applied to the fingernail.

Another object of the present invention is the provision of a curing apparatus including a plurality of lamps for emitting ultraviolet light for curing the coating and bonding material.

Another object of the present invention is the provision of a curing apparatus including a first, second and third lamp with the first lamp secured to a top wall of the enclosure and the second and third lamps being secured to a rear wall of the enclosure.

Another object of the present invention is the provision of a curing apparatus which includes an on/off electrical timer switch for energizing the lamps which emit ultraviolet light and timing their duration.

Another object of the present invention is the provision of a curing apparatus in which the finger guide includes a shaped block for enabling the person whose nails are surfaced or coated with a ultraviolet light sensitive coating and bonding material, to grip the block such that the person's fingernails and attached nail tips are exposed to said ultraviolet light when the block is disposed in the predetermined location thereby resulting in an evenly cured, tightly bonded, contiguously level coat and smoothly surfaced nail tip.

A further object of the present invention is the provision of a curing apparatus having a first rail means which includes a first and a second track secured to the block with the first and second tracks spaced and parallel to each other and a second rail means including a third and fourth track secured to the base of the enclosure. The third and fourth tracks are spaced and parallel relative to each other such that the first and the third tracks and the second and fourth tracks interconnect for guiding the block from the opening towards the predetermined location.

The foregoing has outlined some of the more pertinent objects of the present invention. These objects should be construed to be merely illustrative of some of the more prominent features and application of the invention. Many other beneficial results can be obtained by applying the disclosed invention in a different manner or modifying the invention within the scope of the invention. Particularly with regard to the use of the invention disclosed herein, this should not be construed to be limited to a curing apparatus for curing an ultraviolet sensitive coating and bonding material applied to the surface of one nail including an artificial tip attached or glued thereon, but should be construed as applicable to curing the ultraviolet sensitive coating and bonding material applied to a plurality of nail surfaces such that sets of nails surfaced with an ultraviolet curing sensitive material may be cured simultaneously.

SUMMARY OF THE INVENTION

The curing apparatus of the present invention is defined by the appended claims with a specific embodiment shown in the attached drawings. For the purpose of summarizing the invention, the invention relates to an apparatus for curing an ultraviolet curable coating and bonding material applied to the surface of a person's fingernail and an artificial nail tip attached or glued thereon or to a person's fingernail alone, if desired. "Fingernail" as used herein embraces both a person's fingernail and an artificial tip attached or glued thereon or a person's fingernail, alone. Furthermore, "fingernail" as used herein also means the thumb nail with or without an artificial tip attached thereon. The apparatus of the invention properly cures the ultraviolet sensitive coating and bonding material to provide a hard, pliable and smooth coated nail surface. The apparatus includes an enclosure having a front face with the front face defining an opening for the reception therein of the artificial nail tip when applied to the fingernail. A plurality of lamps are disposed within the enclosure for emitting ultraviolet light within the enclosure for evenly curing the ultraviolet sensitive material when a person positions the fingernail and applied nail tip to which the ultraviolet curable material has been applied. An electrical timer switch controls the energizing of the plurality of lamps and the time period to which the bonding material within the enclosure is exposed to the ultraviolet light. A finger guide slidably extends through the opening for guiding the person's fingernail and applied nail tip to a predetermined location within the enclosure such that the bonding material is cured at the predetermined location.

In a more specific embodiment of the invention the enclosure includes a base and a first and second side wall extending from the base. The side walls are spaced and parallel relative to each other. A front face extends between the side walls and a rear wall extends between the side walls. A top wall extends between the sidewalls and the front face and rear wall. The enclosure contains a plurality of tubular ultraviolet emitting lamps with a first lamp secured to the top wall, a second lamp secured to the rear wall adjacent to the base and third lamp secured to the rear wall and disposed between the first and second lamps. The switch includes an on/off hand control which is disposed externally relative to the enclosure such that energizing of the lamps is manually controllable by manipulation of the switch. The timer includes a multiposition delay which is manually controllable by rotation of the hand control such that the time period is controllable by actuation of the hand switch. It is preferred, however, to use a combined on/off electrical timer switch which controls both the on/off function and duration of "on" time function of the ultraviolet emitting lamps. Such combination switches are well known.

The guide means includes a shaped block for enabling the person whose nail tips are to be cured to grip the block such that the person's fingernails and attached nail tips are exposed to the ultraviolet light when the block is exposed at the predetermined location. The shaped block of the guide means also includes a first rail means which is secured to the block for guiding the block towards the predetermined location and a second rail means is secured to the base and extends from the opening towards the rear wall of the enclosure. The first and second rail means cooperate together such that the first rail means slides longitudinally relative to the second rail means and interconnects therewith for guiding the block between the opening and the predetermined location.

In a specific embodiment of the invention, the finger guide means comprises a first rail means and a second rail means. The first rail means includes a first and a second track with the first and second tracks being spaced and parallel relative to each other. The second rail means includes a third and fourth track with the third and fourth tracks being spaced and parallel relative to each other such that the first and the third tracks interconnect and second and fourth tracks interconnect for guiding the block from the opening towards the predetermined location.

The finger guide means may alternatively be molded into the apparatus base and the shaped block at the time each is molded of, for example, a plastic material. The purpose of the finger guide means is to provide a particular pre-determined distance between the shaped block and the ultraviolet light emitting bulbs.

The foregoing has outlined rather broadly the more pertinent and important features of the present invention in order that the detailed description may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
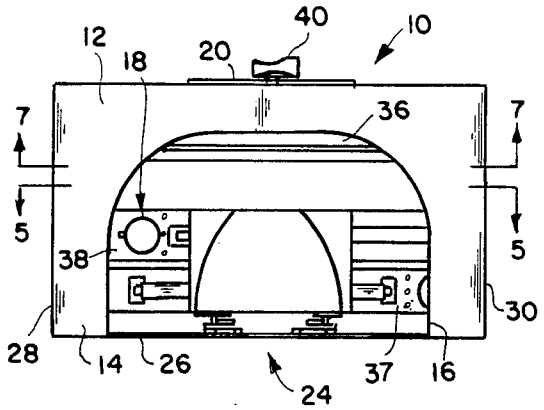
FIG. 1 is a front elevational view of the curing apparatus according to the present invention.
Figure 5:
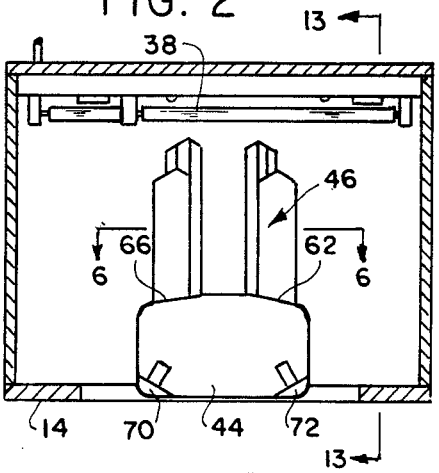
FIG. 5 is sectional view taken on the line 5—5 of FIG. 1.
Figure 4:
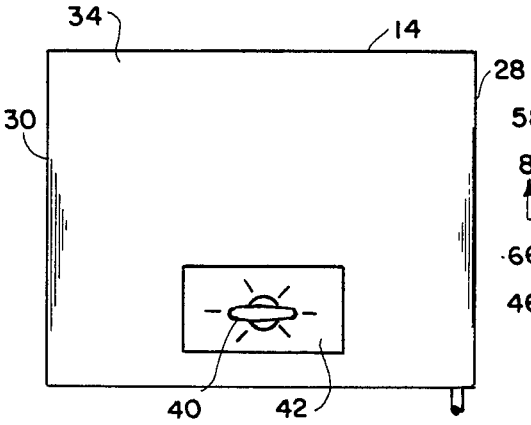
FIG. 4 is a top plan view of the apparatus shown in FIG. 1.
Figure 6:
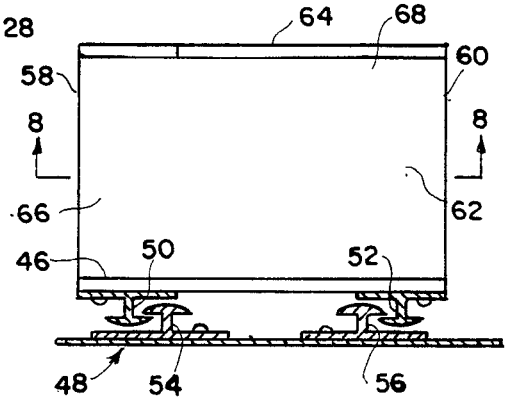
FIG. 6 is an enlarged sectional view taken on the line 6—6 of FIG. 5.
Figure 7:
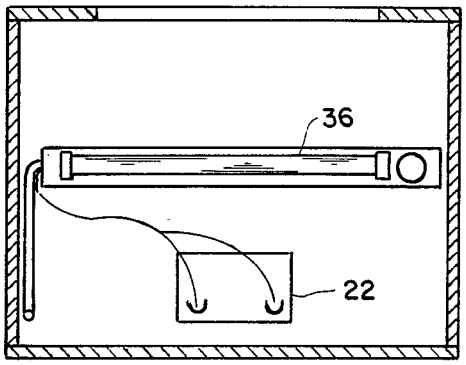
FIG. 7 is a sectional view taken on the line 7—7 of FIG. 1.

FIG. 1 is a front elevation view of an apparatus generally designated 10 for curing an ultraviolet sensitive coating and bonding material applied to the person's fingernail and artificial nail tip. Numerous ultraviolet sensitive polymerizable bonding material formulations are available, for example, BOND-A-LITE (trademark) and LEKTRA BOND GEL (trademark). The apparatus 10 includes an enclosure 12 having a front face 14. The front face 14 defines an opening 16 for the reception therein of the hands of the person, including the curable bonding material. A plurality of tubular lamps generally designated 18 are disposed within the enclosure 12 for emitting ultraviolet light within the enclosure 12 for curing the ultraviolet sensitive material applied to the surface of a fingernail and the artificial nail tip when the person positions the fingernail and applied nail tip within the enclosure 12. An electrical switch 20 controls the energizing of the plurality of lamps 18 and a timer 22 is electrically connected to the switch 20 for controlling the time period to which the ultraviolet sensitive material within the enclosure 12 is exposed to the ultraviolet light. A finger guide means generally designated 24 slidably extends through the opening 16 for guiding the person's coated fingernail and applied nail tip to a predetermined location as shown in FIG. 5 such that the ultraviolet sensitive material is cured at the predetermined location.

Figure 2:
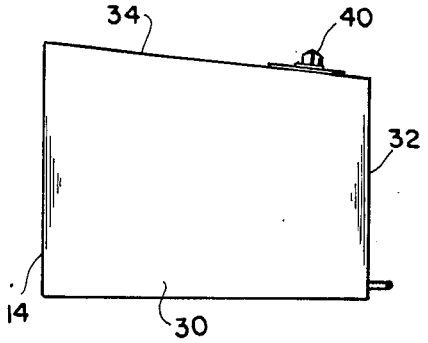
FIG. 2 is a right side elevational view of the apparatus shown in FIG. 1.
Figure 3:
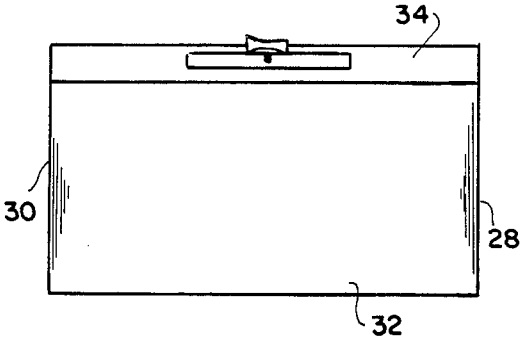
FIG. 3 is a rear elevational view of the apparatus shown in FIG. 1.

As shown in FIGS. 1 and 2, the enclosure 12 includes a base 26, a first and a second side wall 28 and 30 respectively, extending from the base 26. The side walls 28 and 30 are spaced and parallel relative to each other and the front face 14 extends between the sidewalls 28 and 30. A rear wall 32 extends between the side walls 28 and 30 and a top wall 34 extends between the side walls 28 and 30 and the front face 14 and the rear wall 32.

As shown in FIGS. 1, 5, 7, 9 and 10, the plurality of lamps 18 includes a first lamp 36 secured to the top wall 34, a second lamp 37 secured to the rear wall 32 adjacent the base 26, and a third lamp 38 secured to the rear wall 32 and disposed between the first and second lamps 36 and 37, respectively. Line cord 31 brings electrical power to the electrical timer switch. Preferably the lamps 36, 37 and 38 are tubular lamps which emit ultraviolet light when energized such as General Electric's Black Light Blue (product code F-6T5-BLB).

Figure 13:
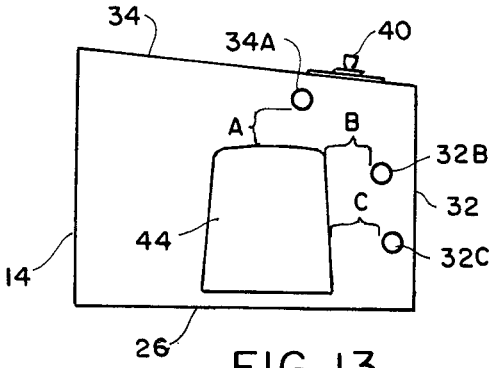
FIG. 13 is a sectional view taken along the line 13—13 of FIG. 5.

Using General Electric's Black Light Blue bulbs, top wall bulb 34A as shown in FIG. 13 is placed within the enclosure so that there is about 1.5 inches between the top of the shaped block 44 to the bottom of the bulb 34A, distance A of FIG. 13. Bulb 34A is placed on top 34 in an area generally above the area where the thumb nails rest on top surface 64 of shaped block 44. The bulbs 32B and 32C placed at the rear wall 32 are positioned so that there is about 1.5 inches between the shaped block 44 and each bulb, distances B and C of FIG. 13. Generally, the length of time to cure the bonding material is directly related to the distance between the ultraviolet emitting bulb and the area to be cured, given the same ultraviolet intensity per unit measurement and the same bonding material.

The electrical timer switch 20 is secured to the top wall 34 and the switch 20 includes an on/off hand control 40 such that energizing of the lamps 36, 37 and 38 is manually controllable by rotation of the switch 20. The timer 22 includes a multi-position delay 42 which is manually controllable by further rotation of the hand control 40 such that the time period is controllable by actuation of the hand control 40.

The finger guide means 24 includes a shaped block 44 for enabling the person whose nail tips are to be cured, to grip the block 44 such that the person's fingernails and attached nail tips are properly exposed to the ultraviolet light when the block 44 is disposed at the predetermined location as shown in FIG. 5. The finger guide means may be fixed within the enclosure 12, however, the apparatus is more difficult to use. The guide means 24 preferably not only includes the shaped block 44 but also includes a first rail means generally designated 46 secured to the block 44 for guiding the block 44 towards the predetermined location. A second rail means generally designated 48 is secured to the base 26 and extends from the opening 16 towards the rear wall 32. The first and second rail means 46 and 48, respectively, cooperate together such that the first rail means 46 slides longitudinally relative to the second rail means 48 and interconnects therewith for guiding the block 44 between the opening 16 and the predetermined location.

More specifically, the first rail means 46 includes a first and a second track 50 and 52, respectively, with the first and second tracks 50 and 52 being spaced and parallel relative to each other. The second rail means 48 also includes a third and fourth track 54 and 56 respectively, with the third and fourth tracks 54 and 56 being spaced and parallel relative to each other such that the first and third tracks 50 and 54 interconnect and the second and the fourth tracks 52 and 56 interconnect for guiding the block 44 from the opening 16 towards the predetermined location.

The shaped block 44 insures uniform intensity of ultraviolet light on to the nail surfaces and includes a first and a second side 58 and 60 respectively, a front surface 62 and a top surface 64. The front surface 62 includes a first portion 66 disposed adjacent to the first side 58 and a second portion 68 disposed adjacent to the second side 60. The top surface 64 includes a first area 70 disposed adjacent to the first side 58 and away from the front surface 62. The top surface 64 also includes a second area 72 disposed adjacent to the second side 60 and away from the front surface 64.

Figure 10:
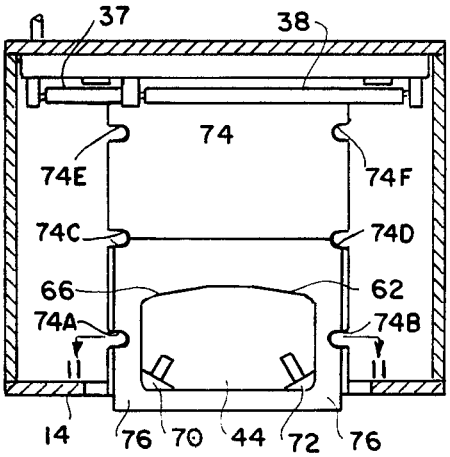
FIG. 10 is a similar view to that shown in FIG. 5 but shows the alternative molded shaped block and molded rail means.
Figure 11:
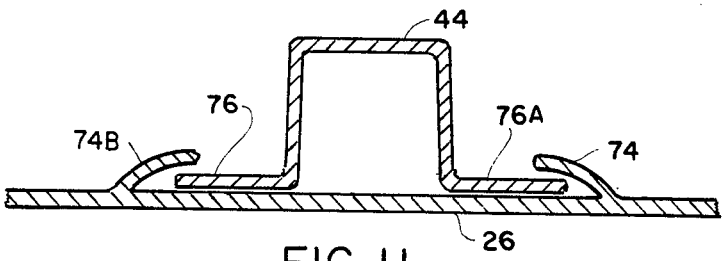
FIG. 11 is a sectional view taken on the line 11—11 of FIG. 10.

In an alternative embodiment, the finger guide means 24 may be molded into the shaped block 44 and into the curing apparatus base 26 in the form of molded guide means 74A–74F, as shown in FIGS. 10 and 11 at the time each is molded of, for example, a plastic material. The purpose of the guide means 24 is to provide a particular pre-determined distance between the shaped block 44 and the ultraviolet light emitting bulbs. That is, the first rail means 76 and the plurality of second rail guide means 74A–74F serve the same function as first rail means 46 and second rail means 48, respectively, as shown in FIG. 10. The number of second rail guide means 74A–74F is the number required to slidably guide the finger guide means 24 to a pre-determined location. FIG. 11 further illustrates shaped block 44 integrally formed with first rail means 76 and second rail means 74A–74F integrally formed with apparatus base 26.

Figure 14:
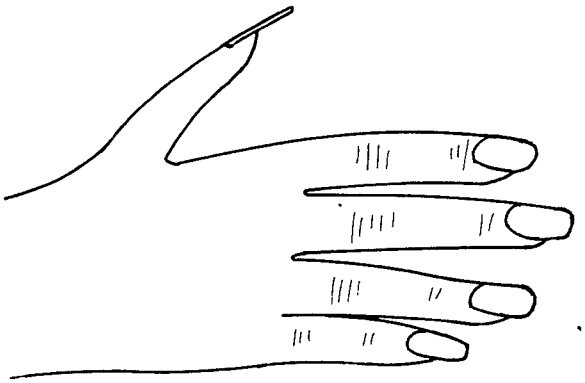
FIG. 14 is a top view of a right hand.

The shaped block 44 conforms to the natural alignment of the hand with the thumb nail in a plane substantially perpendicular to the fingernails, as illustrated in FIG. 14. Thus, when the shaped block 44 is griped by the hands of the person whose fingernail surfaces are to be cured and the shaped block 44 is positioned at the pre-determined location, the placement of the ultraviolet light means relative the nail surfaces results simultaneously and uniform curing of the fingernail surfaces and the thumb nail surfaces.

In operation of the curing apparatus according to the present invention, when the cosmetologist has applied the ultraviolet sensitive material to the person's fingernails, the person places the left hand adjacent to the first side 58 of the block 44. The person's thumb is pressed against the first area 70 with the palm of the person's left hand pressed against the first side 58 and the fingers of the left hand pressing against the first portion 66 of the front surface 62 of the block 44.

Similarly, the person's right hand is placed with the person's right palm pressing against the second side 60 of the block 44 with the person's thumb pressed against the second area 72 of the top surface 64 of the block 44, and with fingers of the right hand pressed against the second portion 68 of the front surface 62 of the block 44.

Collectively, the thumb nail first area 70 (right thumb) and second area 72 (left thumb) are referred to as "second region". Also, collectively the fingernails first portion 66 (left fingers) and second portion 68 (right fingers) are referred to as "first region".

Figure 9:
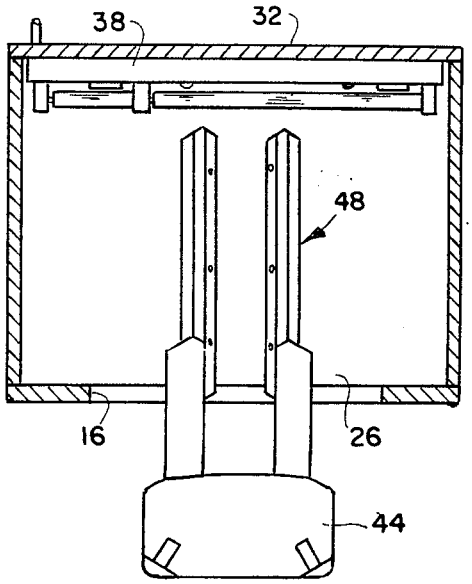
FIG. 9 is a similar view to that shown in FIG. 5 but shows the shaped block disposed away from the predetermined location shown in FIG. 5.
Figure 8:
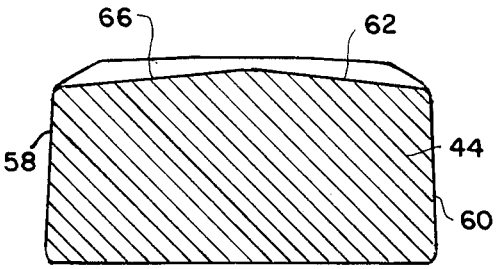
FIG. 8 is a sectional view taken on the line 8—8 of FIG. 6.

With the left and right hand of the person disposed in the aforementioned disposition relative the block 44 and with the block disposed in the disposition shown in FIG. 9, the person then urges the block 44 inwardly along the tracks 50, 52, 54 and 56 respectively, until the block 44 is disposed at the predetermined location as shown in FIG. 5. The molded guide means 74A–74F and 76 and molded shaped block 44 are operable in the same manner as described above.

With the hands and fingernails disposed at the predetermined location as shown in FIG. 5, the cosmetologist rotates the hand control 40 of the combined switch and timer to the required disposition thereof for energizing the lamps 36–38 such that the ultraviolet sensitive material applied to the surface of the fingernails and nail tips are exposed to ultraviolet light for a correct period of time and the correct distance from the respective lamps 36–38, so that the bonding material is suitably cured.

The present invention provides an apparatus of simple construction which enables bonding of artificial nail tips to a person's fingernails without the danger of overexposure to the ultraviolet light by the combination of a timer for timing the curing process and for maintaining the ultraviolet sensitive material at a predetermined distance relative to the respective lamps.

Figure 12:
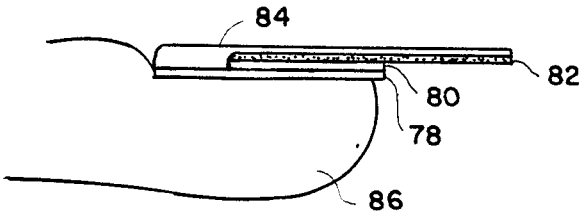
FIG. 12 is a partial sectional view illustrating a finger tip with a natural fingernail and on artificial tip attached thereon with a polymerized ultraviolet sensitive material thereon.

FIG. 12 illustrates finger 86 with natural nail 78 bonded to an artificial nail tip 82 by a glue 80 with both nails 78 and 82 coated and bonded by ultraviolet sensitive material 84.

The present disclosure includes that contained in the appended claims as well as that of the foregoing description. Although this invention has been described in its preferred forms or embodiments and methods with a certain degree of particularity, it is understood that the present disclosure of the preferred form has been made only by way of example and that numerous changes in the details of construction and use of the combination and arrangement of parts may be resorted to without departing from the spirit and scope of the invention.

What is claimed is:

1. An apparatus for curing an ultraviolet curable coating and bonding material applied to the fingernail surfaces and thumbnail surfaces of a person upon the application of electrical power comprising in combination:

an enclosure having an opening therein for receiving the hands of a person;

a plurality of lamps disposed within the enclosure for emitting ultraviolet light for curing the ultraviolet curable material applied to the fingernail surfaces and thumbnail surfaces of the hand of the person;

an electrical timer switch interposed between the power source and the plurality of lamps for controlling electrical power to the plurality of lamps in accordance with a preselected duration of said electrical timer switch;

finger guide means disposed within said enclosure for locating the hand of the person with the fingernail surface of the fingers being disposed along a first region and with the thumb nail of the person being located in a second region; and said plurality of lamps being disposed within said enclosure for irradiating the fingernail surfaces of the person and the thumb nail surface of the person for producing simultaneously and uniform curing of the fingernail surfaces and the thumb nail surfaces.

2. The apparatus as set forth in claim 1, wherein the enclosure further includes:

a base;

a first and second sidewall extending from said base;

said side walls being spaced and parallel relative to each other, said front face extending between said side walls;

a rear wall extending between said side walls; and a top wall extending between said side walls and said front face and said rear wall.

3. The curing apparatus of claim 2, wherein the finger guide means slidably extends through the enclosure opening for guiding the fingernails of a person to a pre-determined location within the enclosure.

4. A curing apparatus as set forth in claim 1, wherein said plurality of lamps are tubular lamps.

5. A curing apparatus as set forth in claim 2, wherein said plurality of lamps further includes:

a first lamp secured to said top wall;

a second lamp secured to said rear wall adjacent to said base; and a third lamp secured to said rear wall and disposed between said first and second lamp.

6. A curing apparatus as set forth in claim 5, wherein said first, second and third lamps are tubular lamps.

7. A curing apparatus as set forth in claim 3, wherein said finger guide means further includes:

a shaped block;

a first rail means secured to said block for guiding said block towards said predetermined location;

a second rail means secured to said base and extending from said opening towards said rear wall, said first and second rail means cooperating together such that said first rail means slides longitudinally relative to said second rail means and interconnects therewith for guiding said block between said opening and said predetermined location.

8. A curing apparatus as set forth in claim 7, wherein said first rail means further includes:

a first and a second track, said first and second tracks being spaced and parallel relative to each other;

said second rail means further including:

a third and fourth track, said third and fourth tracks being spaced and parallel relative to each other such that said first and third tracks interconnect and said second and fourth tracks interconnect for guiding said block from said opening towards said predetermined location.

9. A curing apparatus as set forth in claim 3, wherein said finger guide means further includes:

a shaped block;

a first rail means integrally formed with said shaped block for guiding said block towards said predetermined location;

a plurality of second rail guide means integrally formed with said base are positioned from said opening towards said rear wall, said first rail means and second rail guide means cooperating together such that said first rail means slides longitudinally and within said second rail guide means and slidably connects therewith for guiding said block between said opening and said predetermined location.

* * * * *